US005505097A

United States Patent [19]

Suovaniemi et al.

[11] Patent Number: 5,505,097

[45] Date of Patent: Apr. 9, 1996

[54] PIPETTE

[76] Inventors: Osmo Suovaniemi, Verkkosaarenkatu 4, SF-00580 Helsinki, Finland; Pertti Ekholm, Malminkatu 24 D 44, SF-00100 Helsinki, Finland

[21] Appl. No.: 104,074

[22] PCT Filed: Feb. 4, 1992

[86] PCT No.: PCT/FI92/00031

§ 371 Date: Aug. 5, 1993

§ 102(e) Date: Aug. 5, 1993

[87] PCT Pub. No.: WO92/13638

PCT Pub. Date: Aug. 20, 1992

[30] Foreign Application Priority Data

Feb. 5, 1991 [FI] Finland ..... 910548

[51] Int. Cl.[6] ..... B01L 3/02

[52] U.S. Cl. ..... 73/864.18

[58] Field of Search ..... 73/864.16, 864.17, 73/864.18; 422/100

[56] References Cited

U.S. PATENT DOCUMENTS 3,707,107 12/1972 Bier ..... 411/423
4,101,283 7/1978 Sundstrom ..... 73/864.16 X
4,346,920 8/1982 Dailey et al. ..... 285/89
4,554,134 11/1985 Tervamäki et al. ..... 73/864.18 X
4,671,123 6/1987 Magnussen, Jr. et al. ..... 73/864.16

FOREIGN PATENT DOCUMENTS 0067605 12/1982 European Pat. Off. .
0242179 10/1987 European Pat. Off. .

*Primary Examiner*—Thomas P. Noland
*Attorney, Agent, or Firm*—Merchant, Gould, Smith, Edell, Welter & Schmidt

[57] ABSTRACT

A pipette, comprising: a cylinder (1) with liquid passage (3), a plunger (4), and a plunger operating assembly (5) for moving the plunger in the cylinder; the operating assembly comprising a body (6), a threaded rod (7), an operating member (8) cooperating by mediation of threads with the threaded rod, and a power unit (9) for rotating the threaded rod and the operating member relative to each other for moving the plunger by mediation of the threaded rod and the operating member when the threaded rod and the operating member are rotated relative to each other with the aid of the power unit; the thread of the threaded rod (7) or alternatively that of the operating member (8) being non-linear locally over a certain transition range.

8 Claims, 3 Drawing Sheets

PIPETTE

BACKGROUND OF THE INVENTION

The present invention concerns a pipette comprising a cylinder which constitutes a cylinder volume with liquid passage; a plunger placed to be reciprocatingly movable in said cylinder volume; and a plunger-operating means for moving the plunger within the cylinder; said operating means comprising a body, a threaded rod, an operating member in cooperation by means of a thread with said threaded rod, and a power means for rotating the threaded rod and the operating member relative to each other; said body being connectable to the cylinder and the threaded rod/operating member combination, to the plunger, for moving the plunger by mediation of the threaded rod and the operating member when the threaded rod and the operating member are rotated relative to each other with the aid of the power means.

The filling of a pipette is based on producing a vacuum in the cylinder volume of the pipette by moving the plunger in the cylinder volume. At the same time, liquid which one wants to fill is conducted into the cylinder volume through the tip of the pipette. The true filling volume of the pipette, i.e., the volume of the liquid quantity that has entered the pipette, depends on quite a number of factors, e.g. the displacement volume of the plunger, ambient air pressure, which in turn is due to temperature and gravity, height of the liquid column inside the pipette, air space inside the pipette, inclination of the pipette (which affects the liquid column height), resilience of the plunger sealing, lifting of the pipette (which gives rise to a downward inertia force of the liquid column), tip leakage, adhesion forces between tip and liquid, etc. The air volume of the pipette, in particular, exerts a great effect on the pipetting accuracy.

For the reasons mentioned, the liquid volume, the true filling volume in connection with pipetting, differs from the corresponding displacement volume of the plunger by even as much as several per cent. The error is highest in high precision pipettes which are meant to be used in a wide operating range, e.g. from 10 μl to 100 μl or 100 to 1000 μl. The highest error percentages are encountered at the lowest rated volumes, even up to 2 to 3%.

In practice, when the true filling volume of the pipette is considered in relation to the displacement volume of the plunger, at the beginning too little liquid enters the pipette, compared with the displacement volume of the plunger, possibly mainly owing to the air volume of the pipette. As operating the pipette is continued, its true filling volume approaches relatively the theoretical displacement volume of the plunger. Therefore the relative error is highest expressly at the lowest filling volume of the pipette.

SUMMARY OF THE INVENTION

The object of the present invention is to eliminate the above-mentioned drawback. It is in particular an object of the invention to provide a novel kind of pipette in which the difference between true filling volume and theoretical filling volume can be minimized.

It is in particular an object of the invention to provide a high precision pipette in the case of which the relative error between its true filling volume and its theoretical filling volume can be eliminated with substantially higher efficiency than in prior art also at low rated volumes.

The invention is based on that the thread of the threaded rod and/or the operating member is non-linear. The thread is advantageously non-linear in such a way that the non-linearity of the thread causes a non-linear, that is non-uniform, motion of the plunger. Thus, in the pipette of the invention, when the threaded rod and operating member are rotated relative to each other with constant speed, the true movement of the plunger, that is the displacement volume, is not uniformly consistent with the rotary movement, owing to the non-linearity of the thread and, for instance, the plunger displacement volumes corresponding to a given angle of rotation of the threaded rod/operating member combination are not consistent throughout the range of rotation of the threaded rod and operating member.

The thread of the threaded rod and/or the operating member is advantageously non-linear so that uniform rotary movement of the threaded rod and operating member relative to each other, transmitted by the thread, produces a maximum in the axial movement between the threaded rod and the operating member, and thereby minimizes the movement, in that region which corresponds to the start of plunger movement from zero volume of the volume, i.e., of the cylinder volume, in the filling direction. Thereby, said maximum in the plunger movement compensates for the error due to the air volume of the pipette, in the region close to zero volume of the pipette, in the filling direction.

The non-linearity of the thread is advantageously based on the flank angle of one flank of the thread being constant ($\alpha$) over part of the thread and constant and greater ($\alpha^1$) over part of the thread and the smaller flank angle increasing up to the greater one in a transition range. Then, part of the other flank of the thread, i.e., of the supporting surface, may be removed over part of the thread so that the pitch of the supporting surface changes in the transition range; in the transition range that part of the thread on which some of the supporting surface has been removed joins the remaining part of the thread. The pitch of the thread is then mainly uniform over the whole range of the thread. The non-linearity of the thread is only observable on one supporting surface of the thread, the inclination ($\alpha$) of which is different on part of the thread from that on the remainder of the thread ($\alpha^1$). In the transition range the inclination $\alpha$ of the non-linear supporting surface changes to become the inclination $\alpha^1$. The change may be linear or otherwise regular, or irregular. The pitch of the other flank of the thread, i.e., of the other supporting surface, may be completely uniform over the entire range of the thread. Thanks to the supporting surface formed by the changing angle of the thread's second, non-uniform flank, the rate of movement of the threaded rod and the operating member relative to each other changes, i.e., has its maximum, expressly at the transition range, to revert to its original value after the transition range, at constant rotating speed of the threaded rod and the operating member. When the transition range, that is, the threaded rod and operating member, are disposed so that the transition range affects the relative rate of movement of the threaded rod and the operating member in axial direction of the threaded rod exactly from zero volume of the pipette's cylinder volume in the filling direction, the error between true and theoretical filling volume can be eliminated. It should further be noted that as long as the pitch of the second flank of the thread, that is of the supporting surface, is fully uniform, the true and theoretical emptying volumes of the pipette are mutually consistent on the basis of the rotation of threaded rod and operating member, as measured when the pipette is being discharged, i.e., in the entire emptying range corresponding substantially linearly, that is uniformly, to the rotation of threaded rod and operating member relative to each other at uniform rate.

It should be noted that in the pipette of the invention the thread of the threaded rod may be non-linear. In another alternative the thread of the operating member is non-linear.

Furthermore, in an embodiment of the invention, the pitch of the thread of the threaded rod and/or the operating member, that is the pitch angle of the thread, is uniform and constant over part of the thread and different therefrom, equal to another constant, on the remainder of the thread. This embodiment, too, enables inaccuracy caused by the difference between true and theoretical filling volume to be compensated. A thread of this kind is inconvenient regarding manufacturing technique, but its use may be contemplated in some special applications.

Thanks to the invention, and when the conditions in which the pipette is filled are constant, non-uniformity of the thread of the threaded rod and/or the operating member can be applied to eliminate the operating errors due to differences between the true filling volume and the theoretical filling volume (as measured on the basis of the rotations of threaded rod and operating member). The thread of the threaded rod and/or the operating member may then be non-uniform throughout, corresponding to the true filling volume of the pipette.

BRIEF DESCRIPTION OF THE DRAWINGS

The invention is described in the following in detail with the aid of embodiment examples, referring to the attached drawings, wherein.

DETAILED DESCRIPTION OF THE PREFERRED EMBODIMENT

Figure 1:
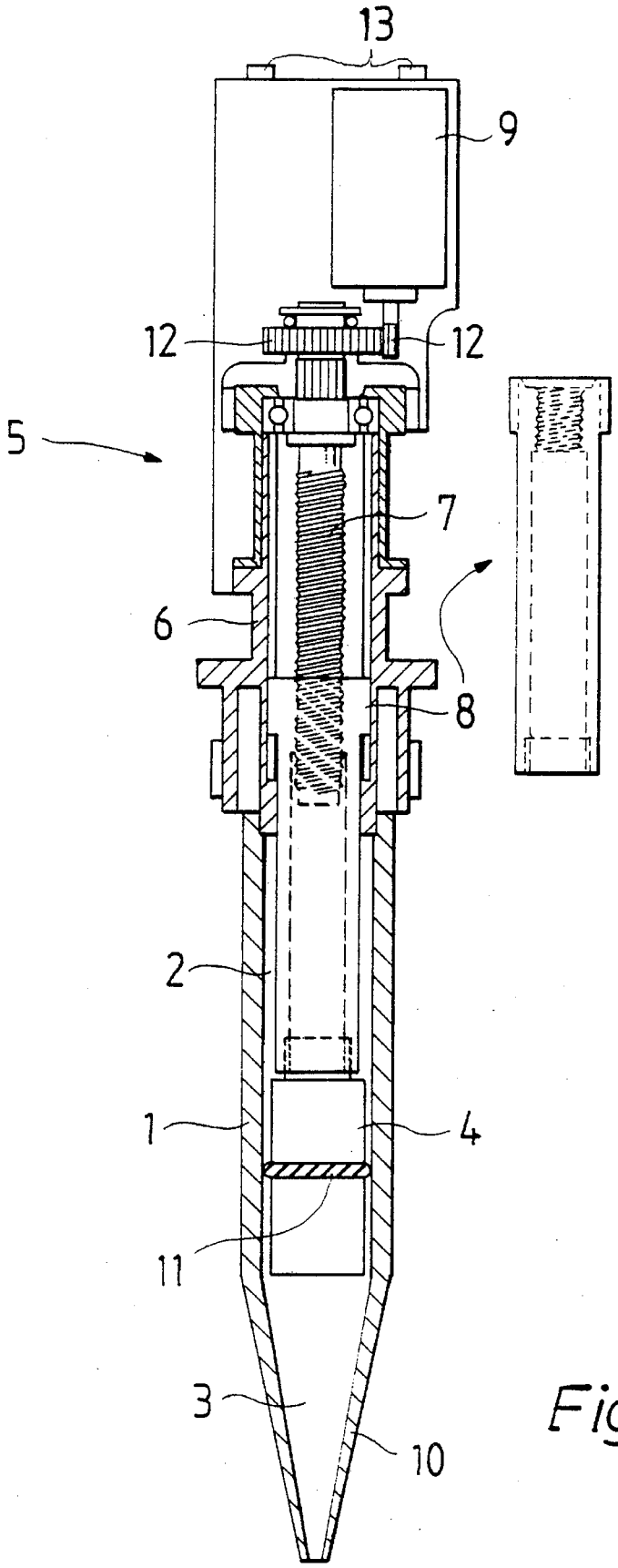
FIG. 1 presents in a schematic diagram, a pipette according to the invention.

In FIG. 1 is depicted a pipette according to the invention. The pipette comprises a cylinder 1 with plunger 4, and an operating means 5 with power means 9. The cylinder 1 constitutes a cylinder volume 2, into which leads a liquid passage 3 formed by the tip 10. The plunger 4 has been disposed in the cylinder volume 2 to be reciprocatingly movable. The plunger is provided with a packing 11. The operating means 5 comprises a body 6, within which a threaded rod 7 is carried to be freely rotatably but substantially immovably relative to the body in the axial direction of the threaded rod. Furthermore, within the body 6 has been installed an operating member 8 to be freely movable in the axial direction of the threaded rod 7 and non-rotatably relative to the body. The threaded rod 7 is with the aid of a thread connected to the operating member, that is, the external thread of the threaded rod is fitted to work with the internal thread of the operating member. The operating means 9 further comprises a power means 9, such as an electric motor, connected through power transfer means, such as gears 12, with the threaded rod 7. The cylinder 9 is attached in extension of the body 6 to be substantially immovable, and the plunger 4 is attached in extension of the threaded rod to be mainly immovable, so that the plunger can be moved to and fro in the cylinder volume along with the threaded rod when the threaded rod 7 and the operating member 8 are set in rotary motion relative to each other with the aid of the power means 9. The running direction of the power means, and thus of the threaded rod and along with it the plunger, is regulated with the aid of push buttons 13, in order to fill or discharge the pipette. The general design of the pipette depicted in FIG. 1 is substantially known in the art and is therefore not described more closely in this context.

Figure 2:
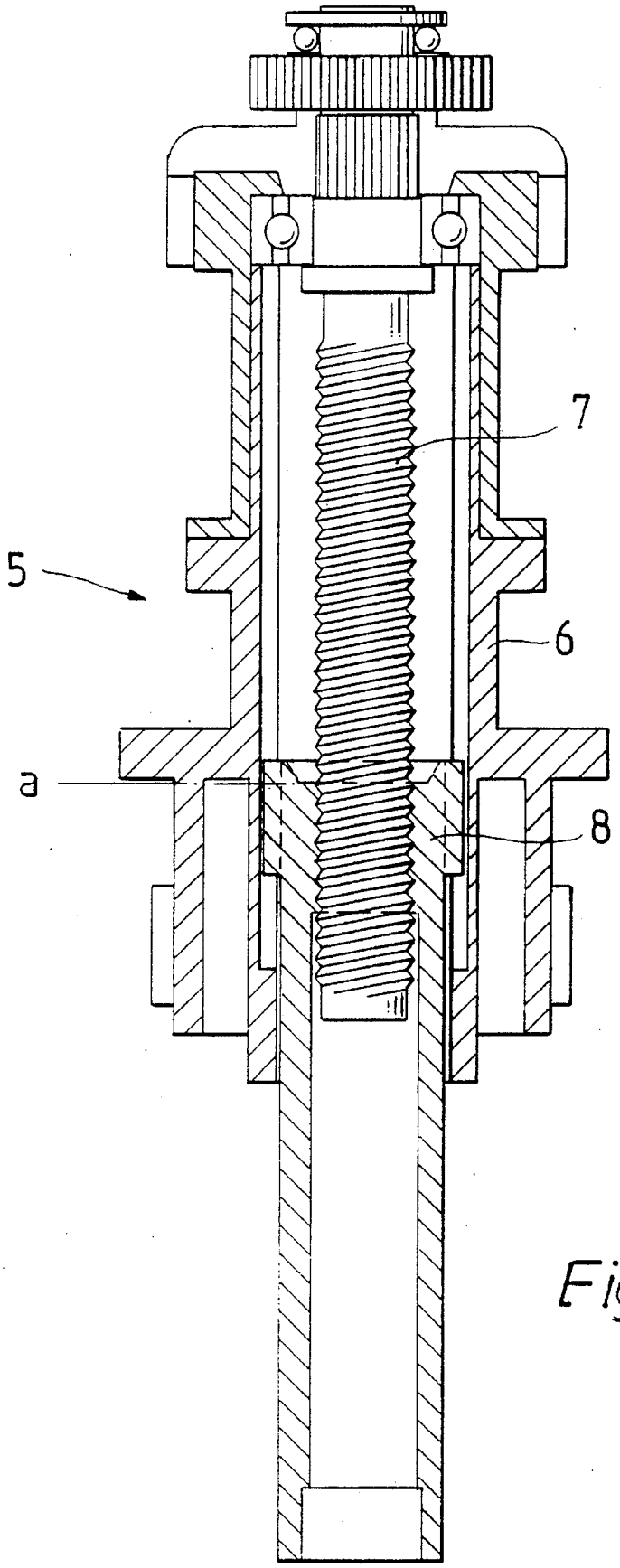
FIG. 2 presents, enlarged, the operating means of the pipette of FIG. 1.
Figure 3:
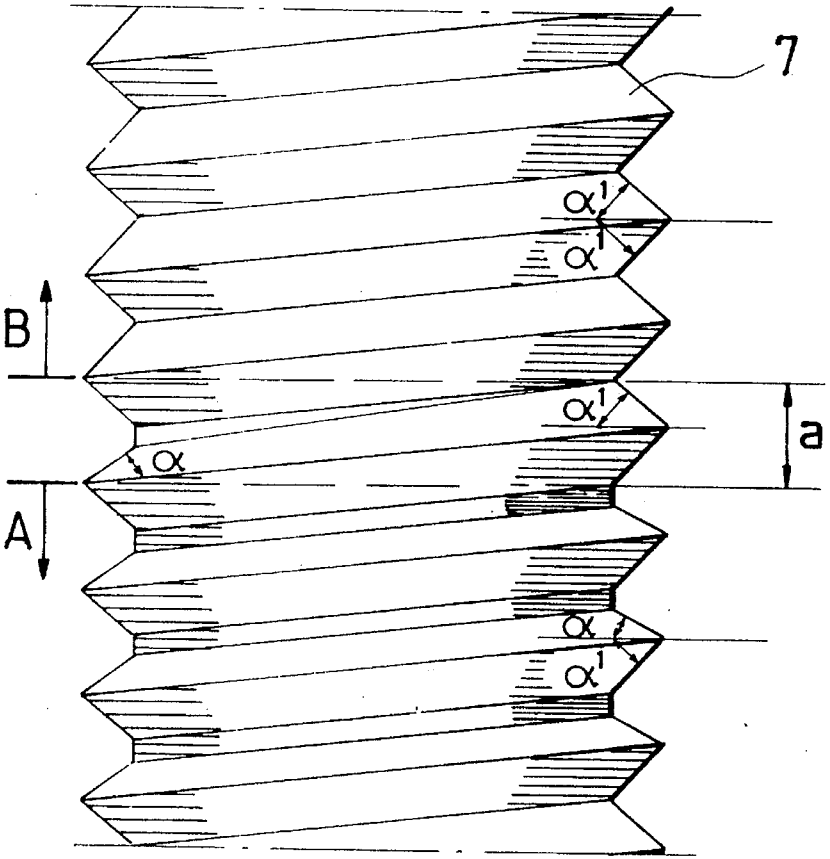
FIG. 3 presents, enlarged, the threaded rod of the operating means of FIGS. 1 and 2.

As taught by the present invention, the pitch of the thread on the threaded rod 7 is non-linear, locally in a certain transition range a, see FIGS. 2–3. In the embodiment here presented, the thread is non-linear in the way that uniform rotary motion of the threaded rod and the operating member relative to each other, transmitted by the thread, causes a maximum in the axial, uniform movement relative to each other of the threaded rod and the operating member in that range which corresponds to the start of the plunger movement from zero volume of the cylinder in the filling direction. In the present embodiment, non-linearity of the thread has been accomplished by means of a special design of the thread. The flank angle of the thread flank is constant, $\alpha$, on part of the thread (the portion in the direction of arrow A), and it is constant and larger, $\alpha^1$, on another part of the thread (the portion in the direction of arrow B). The smaller flank angle $\alpha$ increases up to the larger flank angle $\alpha^1$ in the transition range a, which corresponds just to the desired point of non-uniform plunger movement, that is to the maximum when the movement of the plunger is commenced, from zero volume of the cylinder in the filling direction. The change of flank angle of the thread just described concerns, in the embodiment presented, only that flank of the thread, that is the supporting surface of the thread, on which the inner thread of the operating member rests, i.e., the angle of the flank opposite to the flank of the thread relative to the plunger, or in the figure the upper flank, against the normal on the axis of the threaded rod. The flank angle of the opposite flank of the threaded rod is constant throughout, or $\alpha^1$, in the embodiment presented. Thus, the pitch of the thread is mainly constant and uniform.

In the embodiment depicted in FIG. 3, the transition range of the thread is equivalent to rotation of the threaded rod 7 and the operating member 8 relative to each other through 180°. If desired, the transition range may equally be wider or narrower, depending on the dimensioning of the cylinder in other respects and on the error between the cylinder's true and theoretical filling volumes which one desires to compensate with the aid of the transition range.

Figure 4:
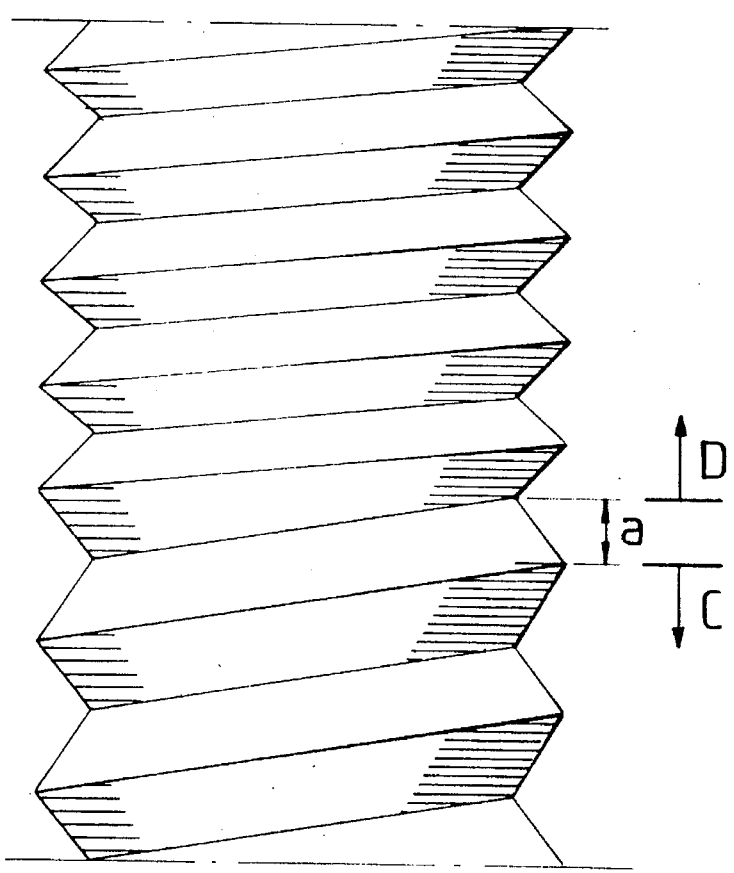
FIG. 4 presents the threaded rod according to another embodiment of the invention.

In the embodiment depicted in FIG. 4, the pitch is larger on a portion (C) of the thread and smaller on the remainder (D) of the thread. The transition range a between these portions corresponds to the transition range of the linear thread, described in the foregoing.

We claim:

1. A pipette, comprising: a cylinder constituting a cylinder volume with a liquid passage; a plunger placed to be reciprocatingly movable in said cylinder volume; and a plunger operating means for moving the plunger in the cylinder; said operating means comprising a body, a threaded rod, an operating member cooperating by mediation of threads with said threaded rod, and a power means for rotating the threaded rod and the operating member relative to each other; said body being connectable to the cylinder and the threaded rod/operating member combination, to the plunger, for moving the plunger by mediation of the threaded rod and the operating member when the threaded rod and the operating member are rotated relative to each other with the aid of the power means, characterized in that the thread of the threaded rod or alternatively that of the operating member, is non-linear locally over a certain transition range; and characterized in that the thread is non-linear in such a manner that uniform rotary motion of the threaded rod and the operating member relative to each other, mediated by the thread, causes a maximum of the axial movement of the threaded rod and the operating member in that range or the thread which corresponds to starting the plunger movement from zero volume of the cylinder volume in the filling direction.

2. Pipette according to claim 1, characterized in that the pitch of the thread is mainly uniform.

3. Pipette according to claim 2, characterized in that the flank angle of one flank of the thread is constant ($\alpha$) on a portion of the thread and constant and larger ($\alpha^1$) on another portion of the thread, and the smaller flank angle ($\alpha$) increases up to the larger flank angle ($\alpha^1$) in a transition range.

4. Pipette according to claim 3, characterized in that on part of the thread there is a uniform pitch and on the remaining part, a pitch differing from the preceding.

5. Pipette according to claim 4, characterized in that the transition range is equivalent to rotation through less than 360° of the threaded rod and the operating member relative to each other.

6. Pipette according to claim 2, characterized in that the flank angle of one flank of thread is constant on a portion of the thread, and the flank angle on another portion of the thread is either larger or smaller than the constant flank angle of one flank of thread, when the larger flank angle is constant, the smaller flank angle increases up to the larger flank angle in a transition range, and when the smaller flank angle is constant, the larger flank angle decreases down to the smaller flank angle in a transition range.

7. Pipette according to claim 6, characterized in that on part of the thread there is a uniform pitch and on the remaining part, a pitch differing from the preceding.

8. Pipette according to claim 7, characterized in that the transition range is equivalent to rotation through less than 360° of the threaded rod and the operating member relative to each other.

* * * * *